US008720697B2

(12) United States Patent
Pryde et al.

(10) Patent No.: US 8,720,697 B2
(45) Date of Patent: May 13, 2014

(54) SCREEN SECURING DEVICE

(75) Inventors: Bradley Alan Pryde, Beliar (AU); Peter Martin Olsen, Leederville (AU)

(73) Assignee: Ludowici Technologies Pty Ltd, Pinkenba, Queensland (AU)

( * ) Notice: Subject to any disclaimer, the term of this patent is extended or adjusted under 35 U.S.C. 154(b) by 298 days.

(21) Appl. No.: 13/062,925

(22) PCT Filed: Sep. 10, 2009

(86) PCT No.: PCT/AU2009/001195

§ 371 (c)(1),
(2), (4) Date: Jun. 24, 2011

(87) PCT Pub. No.: WO2010/028442

PCT Pub. Date: Mar. 18, 2010

(65) Prior Publication Data

US 2011/0247969 A1 Oct. 13, 2011

(30) Foreign Application Priority Data

Sep. 11, 2008 (AU) ..... 2008904723
May 28, 2009 (AU) ..... 2009902437

(51) Int. Cl.
*B07B 1/46* (2006.01)

(52) U.S. Cl.
USPC ..... 209/455; 209/399; 411/402

(58) Field of Classification Search
USPC ..... 209/319, 399, 403, 405; 411/402, 410
See application file for complete search history.

(56) References Cited

U.S. PATENT DOCUMENTS

| | | | | |
|---|---|---|---|---|
| 2,254,502 | A * | 9/1941 | Thomas et al. | 285/39 |
| 6,206,200 | B1 * | 3/2001 | Gilles et al. | 209/399 |
| 7,273,151 | B2 * | 9/2007 | Sawall et al. | 209/405 |
| 7,841,476 | B2 * | 11/2010 | Johnson et al. | 209/405 |
| 8,025,153 | B2 * | 9/2011 | Freissle et al. | 209/399 |
| 8,025,154 | B2 * | 9/2011 | Kriel | 209/405 |
| 8,123,043 | B2 * | 2/2012 | McGregor et al. | 209/405 |
| 8,127,932 | B2 * | 3/2012 | Trench et al. | 209/405 |
| 8,376,143 | B2 * | 2/2013 | Lane et al. | 209/405 |
| 2006/0108264 | A1 * | 5/2006 | Moore et al. | 209/395 |
| 2006/0180510 | A1 | 8/2006 | Freissle et al. | |
| 2008/0047877 | A1 | 2/2008 | Freissle et al. | |

FOREIGN PATENT DOCUMENTS

| | | |
|---|---|---|
| WO | WO 00/43134 | 7/2000 |
| WO | WO 03/066243 | 8/2003 |

* cited by examiner

*Primary Examiner* — Joseph C Rodriguez
(74) *Attorney, Agent, or Firm* — James W. Hill; McDermott Will & Emery LLP

(57) ABSTRACT

A securing device for securing a screening panel to a support frame of a vibrating screen assembly. The securing device has a body with a securing means at one end and a stub at the lower end. The securing means is shaped to mate with a complementary securing cavity in the screening panel and has a hole that receives a pin located in the securing cavity. The stub may be threaded to engage the support frame.

16 Claims, 10 Drawing Sheets

SCREEN SECURING DEVICE

FIELD OF THE INVENTION

This invention relates to a securing device for holding panels onto a vibrating screen. In particular, it relates to securing resiliently deformable panels suitable for use in a vibrating screen for separating particulate matter, particularly mineral ores.

BACKGROUND TO THE INVENTION

The use of vibrating screens for separating mineral ores is well known. Vibrating screens are used in three related applications: classification; dewatering; and media recovery. Classification is a process of separating feed material into two or more controlled size ranges. Dewatering separates water from the feed material and typically requires a much finer screen than classification. Media recovery is similar to dewatering as the screen is used to recover fluid from the feed material.

In our co-pending international application number PCT/AU2008/000698 titled VIBRATING SCREEN PANEL there is described a novel screen panel that has cross-flow and in-flow slots. In use, the screen panel is secured to a vibrating screen deck. It is preferable for the screen panel to be reversibly secured to the screen deck so that the screen panel can be easily removed and replaced. The screen deck wears out much quicker than any other components of the vibratory machine.

There are various known devices for attaching the screen panels to an underlying support frame. In one prior art system described in U.S. Pat. No. 4,871,288 the screen panels are held in place by elongate securing devices that screw into an underlying sub-frame structure. Each securing device has a head that engages a socket formed by complementary cavities in adjacent screen panels.

Another known arrangement is described in U.S. Pat. No. 6,957,741. Each securing device has a locating protrusion and a securing protrusion that engages a complementary locating recess and securing recess on an overlying screen panel. The combination of the locating protrusions/recesses and securing protrusions/recesses act to hold the screen panel in place on the underlying frame.

Each of the known arrangements have proven to be useful but the performance can be improved.

OBJECTS OF THE INVENTION

It is an object of the present invention to provide a device with improved performance compared to the known prior art, or at least to offer the public a useful alternative.

SUMMARY OF THE INVENTION

In one form, although it need not be the only or indeed the broadest form, the invention resides in a securing device for holding a screening panel to a support frame of a vibrating screen assembly, the securing device comprising:

a body;

a securing means at an upper part of the body for mating with a complementary securing cavity on the screening panel;

a hole formed in the upper part of the body adjacent the securing means for receiving a pin of the screening panel; and a stub at a lower part of the body for engaging a corresponding socket in the support frame.

Preferably the securing device further comprises a flange intermediate the upper end of the body and the lower end of the body.

The securing means may suitably comprise a ridge.

Preferably, the securing means comprises a tapered neck and an enlarged head at the narrower end of the neck. The head may suitably include a circumferential ridge.

Preferably the hole extends through the body from the upper part to the lower part.

In one aspect of the invention the stub is formed as a blank in which a thread is cut by the action of screwing the securing device into the socket in the frame.

Optionally, the flange is suitably shaped at an outer perimeter to be engaged for tightening, preferably by a tool.

In another form the invention resides in a screening panel for a vibratory screen assembly comprising:

a screen deck with multiple screening apertures;

a perimeter enclosing the screen deck;

at least one securing cavity formed in the perimeter, each securing cavity having a shape adapted to receive a securing means; and a pin extending from the perimeter into the cavity for engaging a corresponding hole in the securing means.

Preferably, the securing cavity has a shape adapted to receive securing means in the form of a tapered neck having an enlarged head at a narrower end of the neck.

Further features and advantages of the present invention will become apparent from the following detailed description.

BRIEF DESCRIPTION OF THE DRAWINGS

To assist in understanding the invention and to enable a person skilled in the art to put the invention into practical effect, preferred embodiments of the invention will be described by way of example only with reference to the accompanying drawings, in which.

DETAILED DESCRIPTION OF THE INVENTION

In this specification, adjectives such as first and second, left and right, and the like may be used solely to distinguish one element or action from another element or action without necessarily requiring or implying any actual such relationship or order. Words such as "comprises" or "includes" are intended to define a non-exclusive inclusion, such that a process, method, article, or apparatus that comprises a list of elements does not include only those elements but may include other elements not expressly listed, including elements that are inherent to such a process, method, article, or apparatus.

Figure 1:
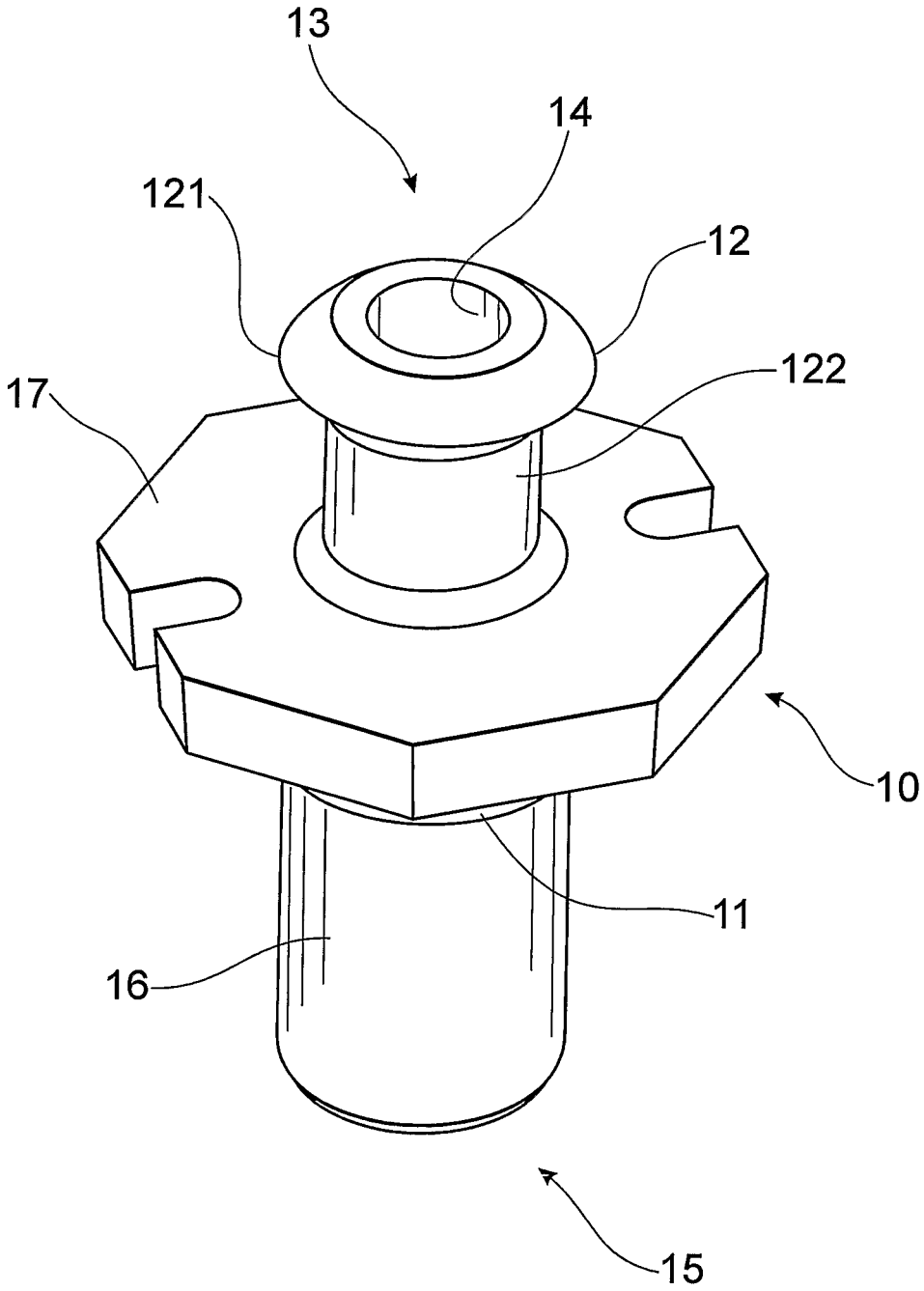
FIG. 1 is a perspective view of a first embodiment of a securing device.
Figure 2:
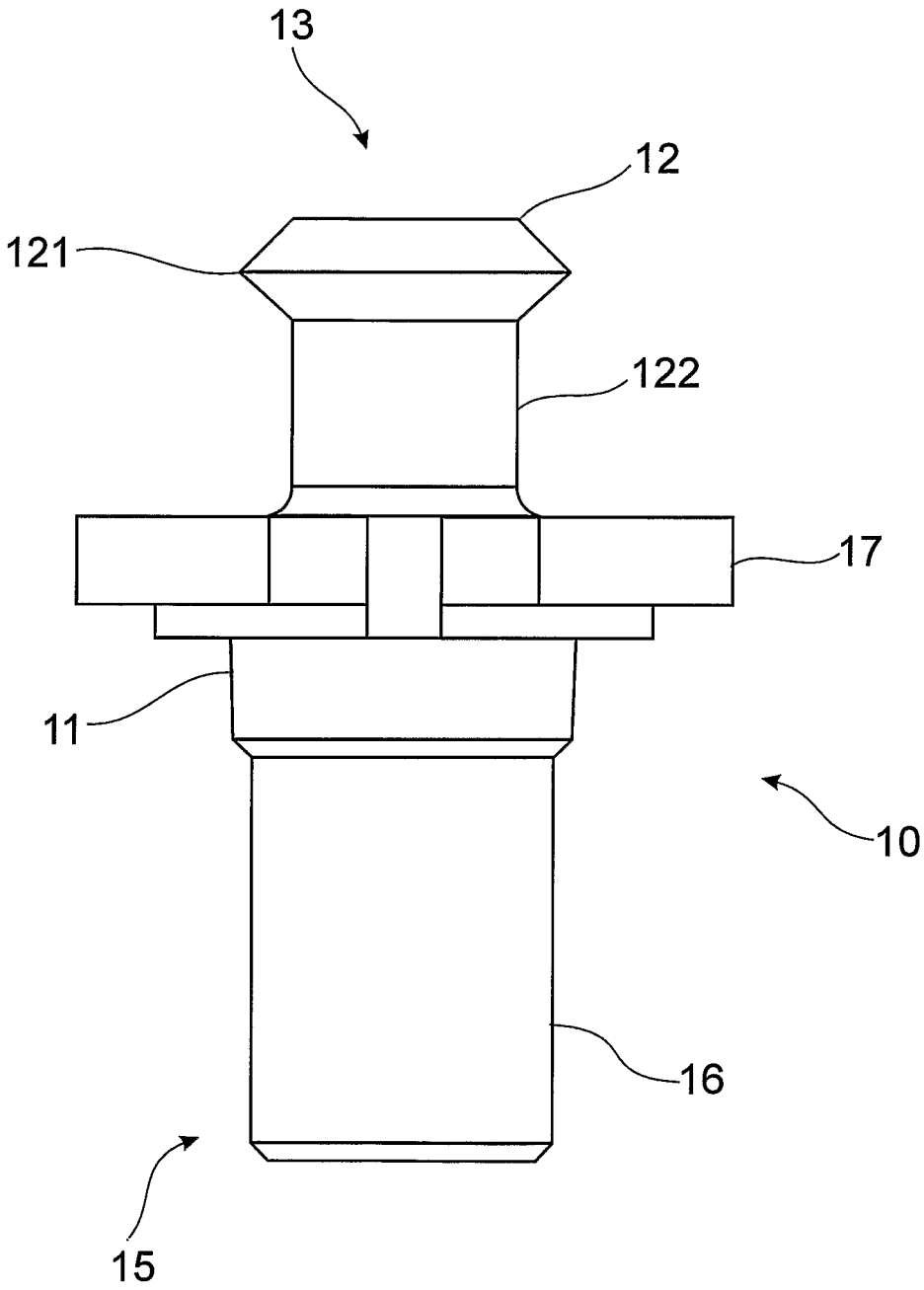
FIG. 2 is a side view of the securing device of FIG. 1.

Referring to FIG. 1 there is a shown a perspective view of one embodiment of a securing device 10. The securing device 10 is formed from plastics material but in other embodiments may be formed from aluminium or other metals. The securing device 10 consists of a body 11 having a securing means 12 at an upper end 13. In the embodiment of FIG. 1 the securing means 12 consists of a ridge 121 near the top of the body 11 that defines a neck 122 below.

A hole 14 is formed in the upper end 13. The hole extends into the body 10 for sufficient distance to receive a pin on a screening panel, as described below. In some embodiments the hole 14 extends through the length of the body 10, as shown in FIG. 8.

At a lower end 15 of the body 11 is a stub 16. As will be described below, the stub engages a corresponding socket on a support frame of a vibrating screen assembly.

Figure 9:
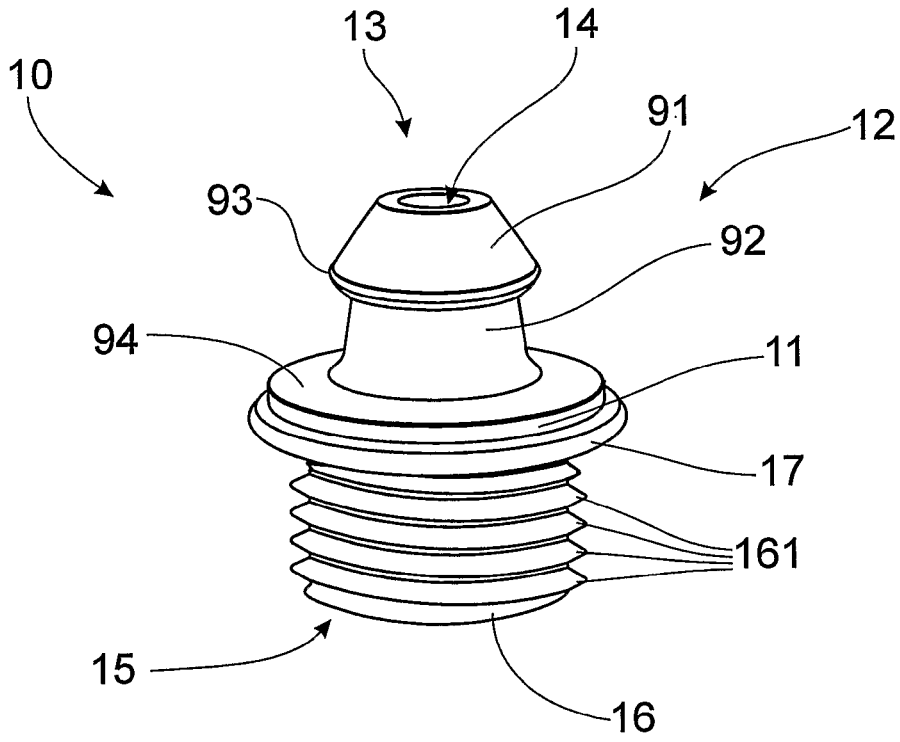
FIG. 9 is a perspective view of another embodiment of a securing device.

A flange may be formed intermediate the upper end 13 and the lower end 15. In the preferred embodiment the flange is shaped to be engaged by a tightening tool to assist with engaging the securing device 10 into the corresponding socket. The flange may be round for tightening by hand but it is more suitably shaped, such as hexagonal shape, so it can be engaged by a wrench or a socket. Although the flange is shown as pronounced in FIG. 1 it may be more subtle, as shown in FIG. 9. In some embodiments there may not be a requirement for a flange.

Figure 3:
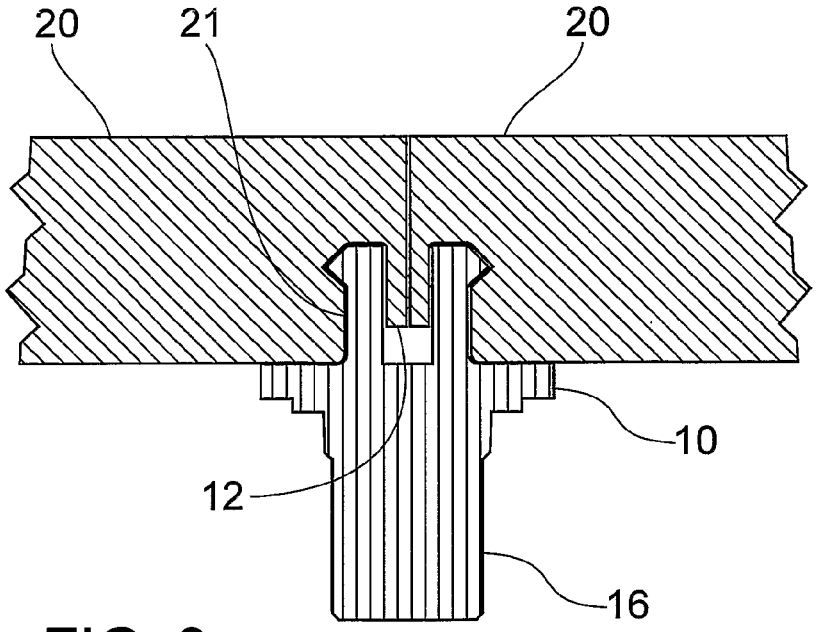
FIG. 3 is a sectional side view of the securing device of FIG. 1 holding a pair of adjacent screen panels.

Referring to FIG. 3, there is shown a sectional side view of the securing device of FIG. 1 holding adjacent screening panels 20. Each screen panel 20 has a securing cavity 21 shaped to receive the securing means 12 (as seen most clearly in FIG. 4). The securing cavity 21 has a half round shape centred on a pin 22. The pin 22 also has a half round shape such that abutting screening panels form a circular cavity with a central circular pin. The circular pin is sized and shaped to fit within the hole 14 in the upper end 13 of the securing device 10.

The circular cavity formed by the abutting securing cavities 21 serves to locate the screen panels 20 on the securing device 10 and the circular pin formed by the abutting pins 22 locates within the cavity 14. The combination of the pin and the cavity serves to firmly but removably hold the screen panels 20 on the securing device 10.

It will be appreciated that the securing means 12, securing cavity 21, hole 14 and pin 22 are not limited to the shapes shown in the preferred embodiment. The securing cavity 21 may have any shape that corresponds to the shape of the securing means 12. The shape of the securing means may be, for example, square or hexagonal. Similarly the hole may be square or hexagonal. For ease of manufacture a circular shape is preferred.

Figure 4:
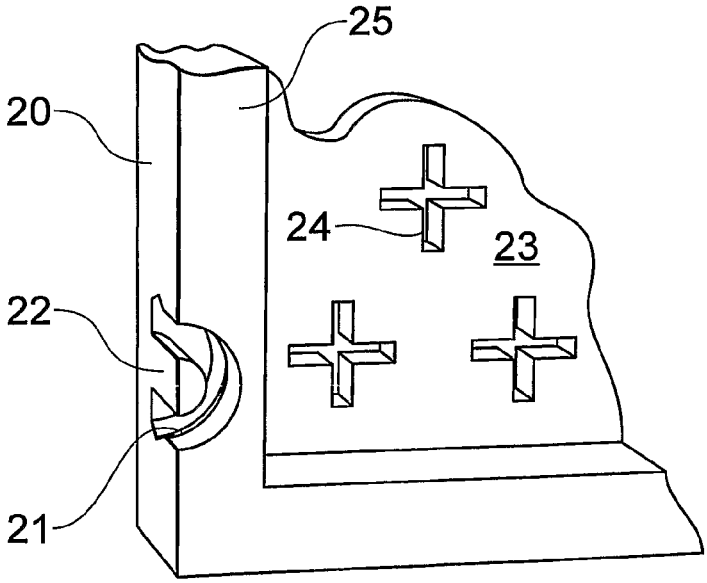
FIG. 4 is an underside view of a screen panel of FIG. 3.

The structure of a screen panel 20 is seen most clearly in FIG. 4. Each screen panel 20 is formed from plastics material, most commonly polyurethane. The screen deck 23 includes multiple screening apertures such as 24. The screen panel 20 has a perimeter 25 that is thicker than the screen deck 23. The security cavity 21 and pin 22 are formed in the perimeter 25 at the time of moulding the screen panel.

Figure 5:
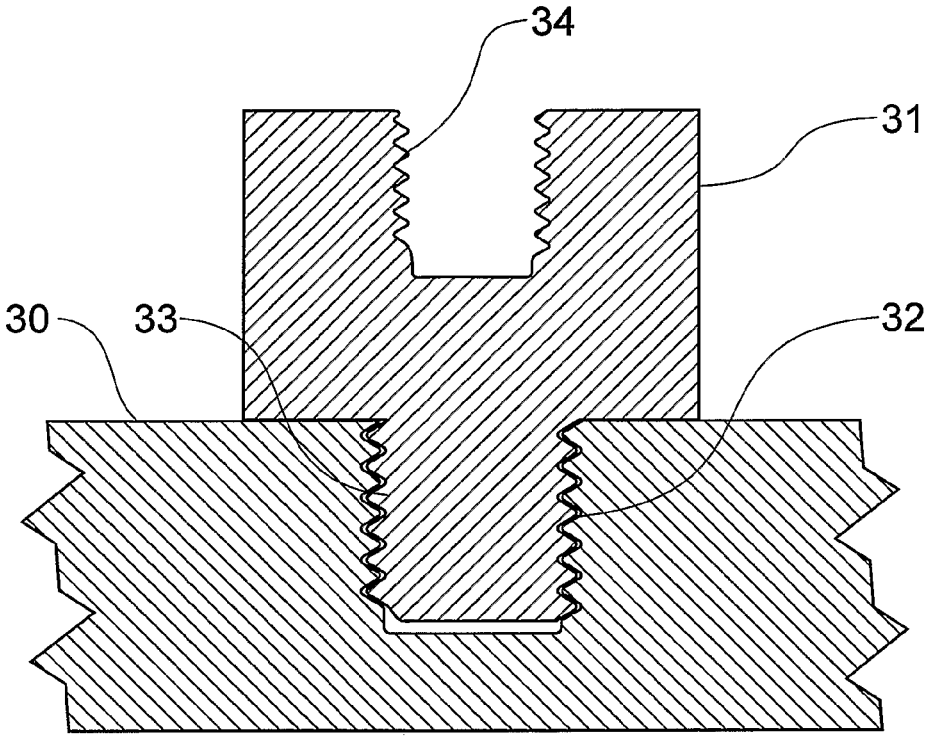
FIG. 5 is a sectional view of a support frame of a vibrating screen assembly.
Figure 6:
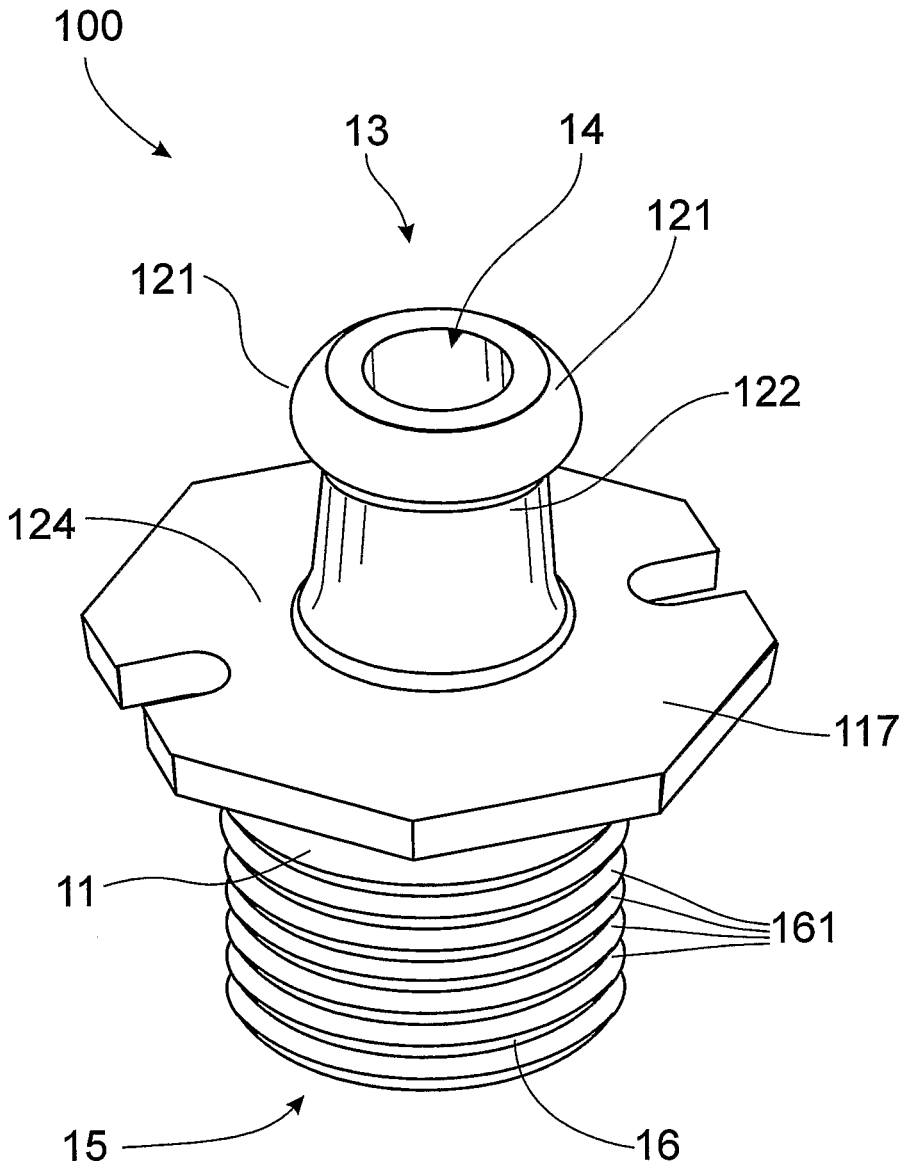
FIG. 6 is another embodiment of a securing device.

The securing device 10 may be connected directly to a frame 30 or via an adapter 31, as shown in FIG. 5. There are various types of screening machines in the market and each has a different arrangement for holding screen panels. In one method of assembly the securing device 10 is screwed directly in the frame 30, as shown in FIG. 6 and discussed later. However the dimensions of the securing device 10 may not match the dimensions of a hole 32 in the frame 30 and an adapter 31 will be needed.

The invention is not limited to any particular screening machine or frame design. By way of example, an adapter 31 may include a threaded section 33 that is designed to match with a thread in the hole 32 in the frame 30. Alternatively there may not be a thread and the adapter 31 may be welded or glued into the hole 32. In another embodiment the adapter 31 may be forced into the hole 32 and be held by an interference fit. Other attachment techniques will be known to persons skilled in the art.

If an adapter 31 is used it is preferable that the securing device 10 is screwed into the adapter 31 so it can be removed. In one preferred embodiment a thread is cut into the stub 16 by the action of screwing the securing device 10 into a threaded hole 34 in the adapter 31. The thread in the threaded hole 34 is suitably hardened and the stub 16 is suitably softer so that a thread is cut in much the same way as a die is used to cut a thread on a bolt.

It has been found that D series polymers, such as polyester, polypropylene and polyphenylene sulphide are suitable materials due to their mechanical properties.

If the dimension of the hole 32 in the frame 30 matches the dimension of the stub 16, the same self-cutting approach can be used to screw the securing device 10 directly into the frame.

It will be appreciated that a thread 161 can be pre-cut into the stub 16 as shown in FIG. 6. The securing device 10 may be screwed into the adapter 31 or the frame 30. Leaving the stub 16 without a thread facilitates a broader range of possible fixing options.

To facilitate assembly the securing device 10 includes a flange 17. In the preferred embodiment the flange 17 is hexagonal like a conventional hex head bolt. The securing device 10 can be tightened into the hole 32 with a wrench, although it is more convenient to use a socket and air gun or electric drill. If the securing device is pre-threaded it could be tightened by hand, in which case the flange may be a knurled disc or similar. It will be appreciated that the flange may be any of a broad range of possible structures.

Figure 7:
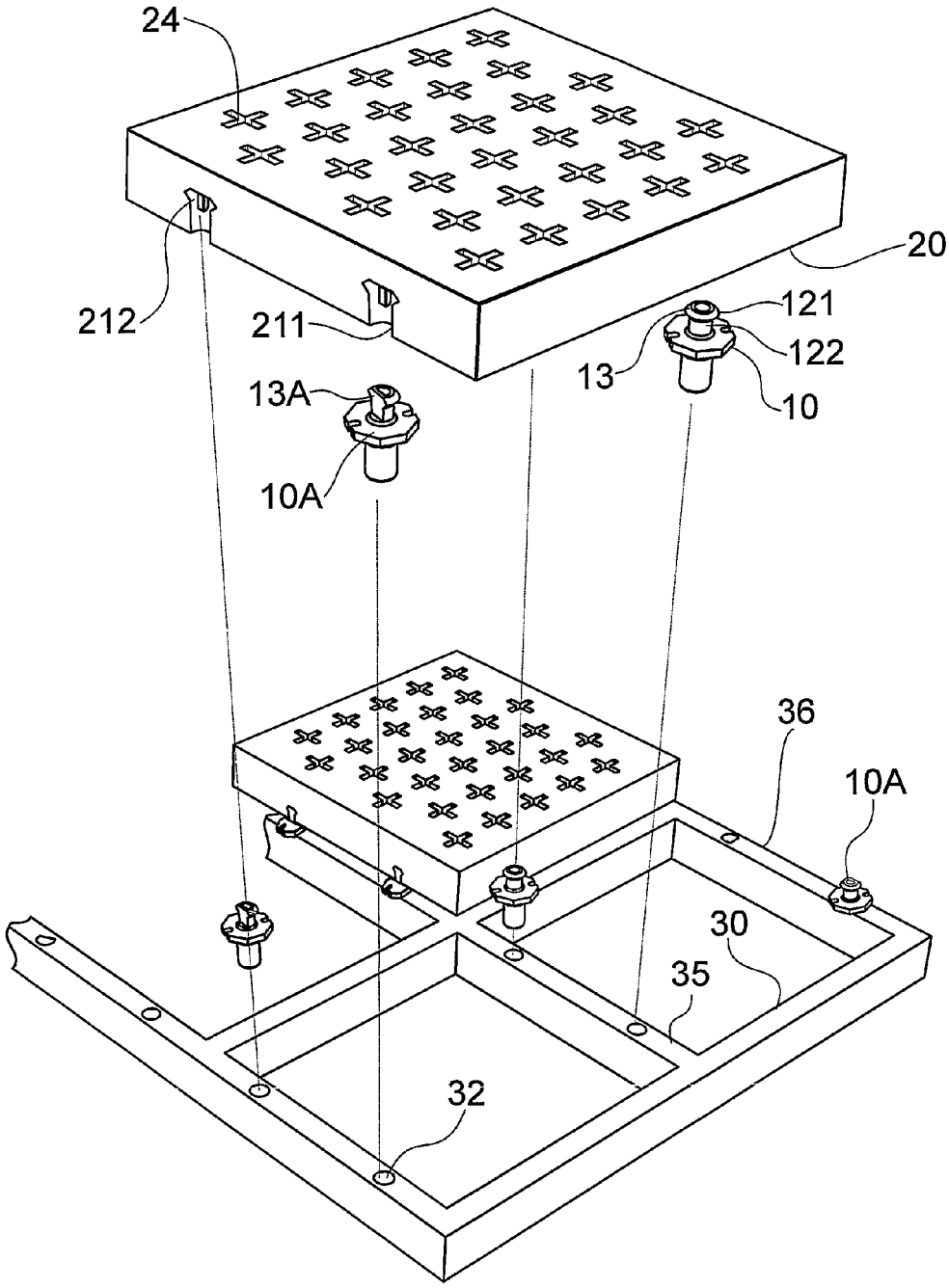
FIG. 7 is an exploded view of a vibrating screen assembly employing the securing device.

Assembly of screen panels 20 to a frame 30 is shown in FIG. 7. Securing devices 10 are screwed into threaded holes 32 in the frame 30. Securing devices 10 in the middle beam 35 of the frame 30 are of the type described above. On the perimeter beams 36 of the frame 30 the securing device 10A has a modified shape for termination of the screen deck. As shown the upper end 13 of the body 11 is a half shape 13A to fit the securing cavity 21 without an abutting screen panel.

Persons familiar with screening assemblies will appreciate that in most cases it will be suitable to secure the edges of panels by conventional methods using beams and clamps. The modified securing device 10A provides an optional alternative.

Assembly involves fitting the securing devices 10, 10A to holes 32 in the frame 30, with or without adapters 31. Panels are then pressed onto the securing means 12 of each securing device 10, 10A. The securing cavity 21 resiliently deforms as the screen panel 20 is forced over the ridge 121 until a lower part 211 of the securing cavity 21 seats against the neck 122 and an upper part 212 of the securing cavity 21 seats against the ridge 121. The process is repeated to position an abutting screen panel.

Screen panels 20 are removed from the securing device 10 by leveraging the screen panel 20 away from the securing device 10. If a securing device 10 is damaged it is removed and replaced.

Figure 8A:
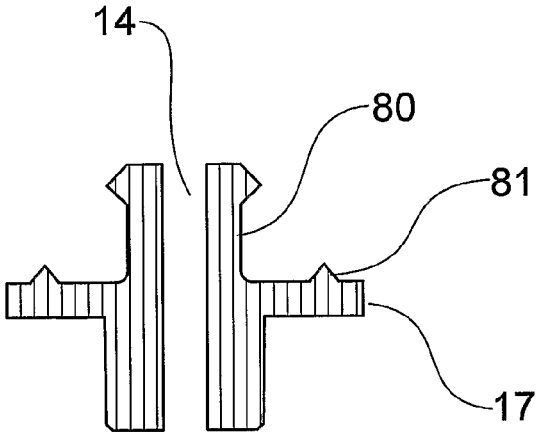
FIG. 8 shows a number of variants of the securing device.

The securing device described in detail above is only one possible embodiment. A number of alternate embodiments are shown in FIG. 8. The embodiment 80 of FIG. 8A is similar to the embodiment of FIG. 1 but with the addition of a securing ridge 81 on the flange 17. The securing ridge mates with a corresponding recess on the underside of a screen panel to provide additional holding strength.

Figure 8B:
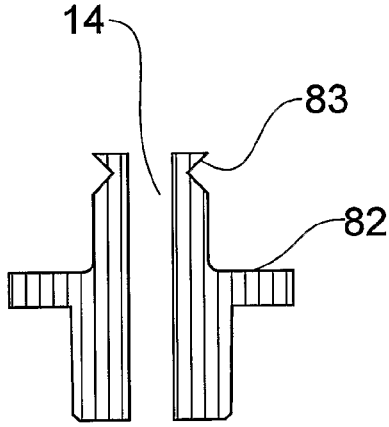
Figure 8C:
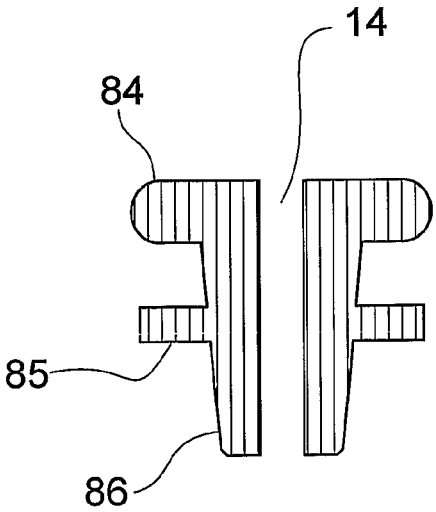

In FIG. 8B the embodiment 82 employs a recess 83 instead of a ridge 121. There will be a corresponding ridge on the inside of the securing cavity 21 in a screen panel 20. The securing means 84 of embodiment 85 in FIG. 8C has a donut profile. A corresponding shape of the securing cavity 21 in a screen panel 20 will provide suitable holding strength. Also shown in the embodiment 84 of FIG. 8C is a tapered stub 86 that may be forced into a hole 32 in a frame 30 or a hole 34 in an adapter 31 with interference fit. A flange may not be necessary for the embodiment of FIG. 8C since the tapered stub 86 can be forced into hole 32 or hole 34 by direct pressure on the upper end 13 of the body 11.

Figure 10:
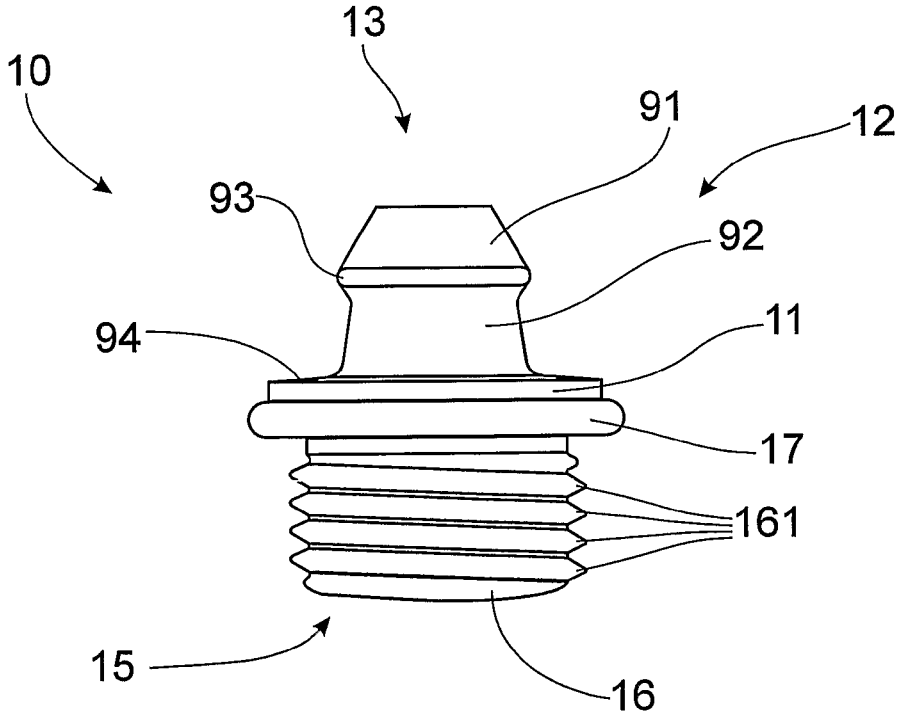
FIG. 10 is a side view of the securing device of FIG. 9.
Figure 11:
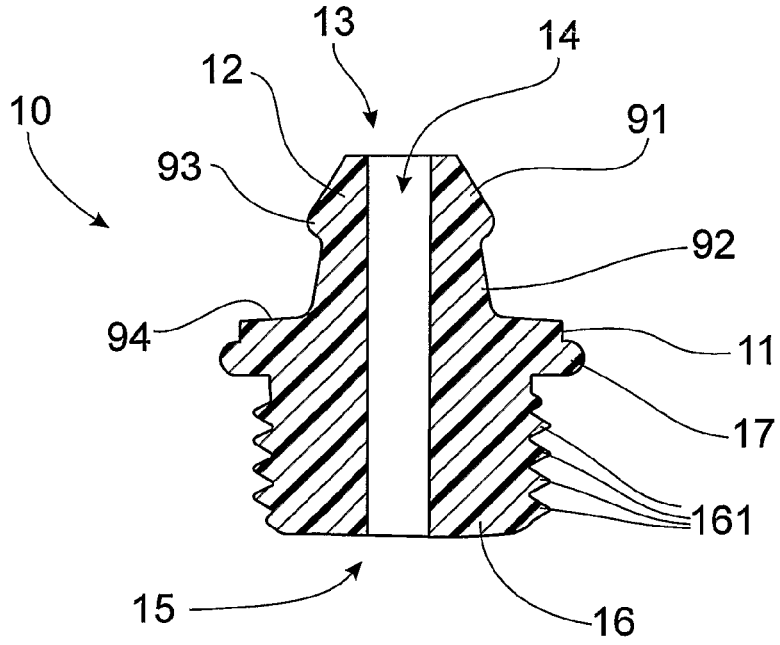
FIG. 11 is a sectional side view of the securing device of FIG. 9.

Referring to FIGS. 9 to 11, there is a shown a perspective view of another embodiment of a securing device 10. The securing device 10 consists of a body 11 having a securing means 12 at an upper end 13. In the embodiment of FIG. 9, the securing means 12 consists of an enlarged head 91 on top of a tapered neck 92 below. The head 91 has a circumferential ridge 93. The head 91 is substantially frusto-conical between the ridge 93 and the upper end of the head 91. The frusto-conical section of the head 91 tapers at an angle of nominally thirty to thirty five degrees. The neck 92 tapers at an angle of nominally ten to fifteen degrees. The neck 92 extends from a collar 94.

A hole 14 is formed in the upper end 13. The hole 14 extends through the body 11 to receive a pin on a screening panel, as described below.

At a lower end 15 of the body 11 is a stub 16 that has pre-cut threads 161. As will be described below, the stub 16 engages a corresponding socket on a support frame of a vibrating screen assembly. Intermediate the upper end 13 and the lower end 15 is a flange 17. The flange may be round for tightening by hand (as shown in FIG. 9).

Figure 12:
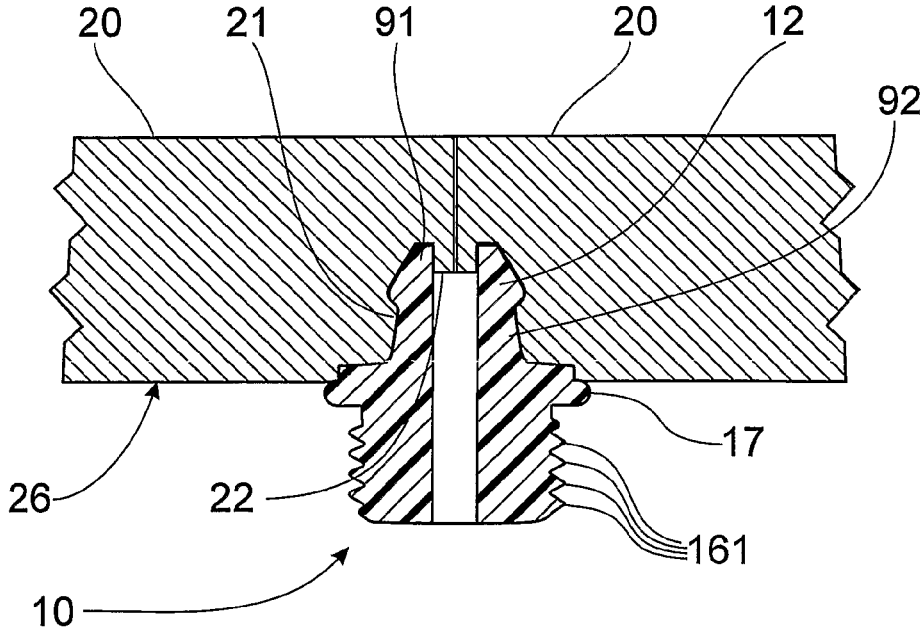
FIG. 12 is a sectional side view of the securing device of FIG. 9 holding a pair of adjacent screen panels.

Referring to FIG. 12, there is shown a sectional side view of the securing device of FIG. 9 holding adjacent screening panels 20. Each screen panel 20 has a securing cavity 21 shaped to receive the head 91 and neck 92 of the securing means 12. The securing cavity 21 has a half round shape centred on a pin 22. The pin 22 also has a half round shape such that abutting screening panels form a circular cavity with a central circular pin. The circular pin is sized and shaped to fit within the hole 14 in the upper end 13 of the securing device 10. The relative length and thickness of the pins 22 allow for ease of capture of the pins 22 within the hole 14.

The circular cavity formed by the abutting securing cavities 21 serves to locate the screen panels 20 on the securing device 10 and the circular pin formed by the abutting pins 22 locates within the hole 14. The combination of the pin and the cavity serves to firmly but removably hold the screen panels 20 on the securing device 10. The shape and configuration of the head 91 and neck 92 of the securing means allows for ease of insertion of the securing means 12 into the circular cavity. The relative thickness and the size of the taper of the head 91 and neck 92 are specific for ease of insertion of the securing means 12 into the circular cavity.

It will be appreciated that the securing means 12, securing cavity 21, hole 14 and pin 22 are not limited to the shapes shown in the preferred embodiment. The securing cavity 21 may have any shape that corresponds to the shape of the securing means 12. The shape of the securing means may be, for example, square or hexagonal. Similarly the hole 14 may be square or hexagonal. For ease of manufacture a circular shape is preferred.

Figure 13:
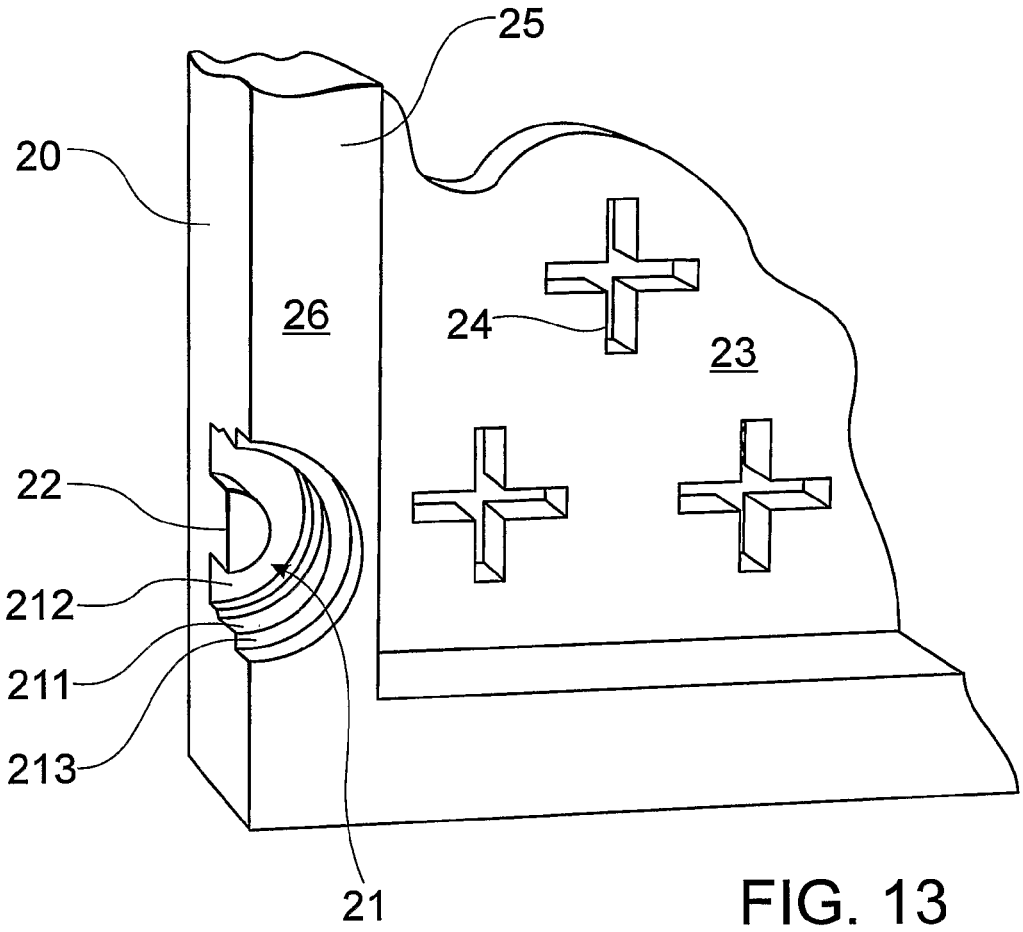
FIG. 13 is an underside view of a screen panel of FIG. 12.

The structure of a screen panel 20 is seen most clearly in FIG. 13. Each screen panel 20 is formed from plastics material, most commonly polyurethane. The screen deck 23 includes multiple screening apertures such as 24. The screen panel 20 has a perimeter 25 that is thicker than the screen deck 23. The securing cavity 21 and pin 22 are formed in the perimeter 25 at the time of moulding the screen panel.

Assembly involves the same process as described by reference to FIG. 7. Panels 20 are pressed onto the securing means 12 of each securing device 10. The securing cavity 21 resiliently deforms as the screen panel 20 is forced over the ridge 93 until a seat 213 of the securing cavity 21 sits against the collar 94, a lower part 211 of the security cavity 21 seats against the neck 92 and an upper part 212 of the securing cavity 21 seats against the head 91. The process is repeated to position an abutting screen panel.

Screen panels 20 are removed from the securing device 10 by leveraging the screen panel 20 away from the securing device 10. If a securing device 10 is damaged it is removed and replaced.

Figure 14:
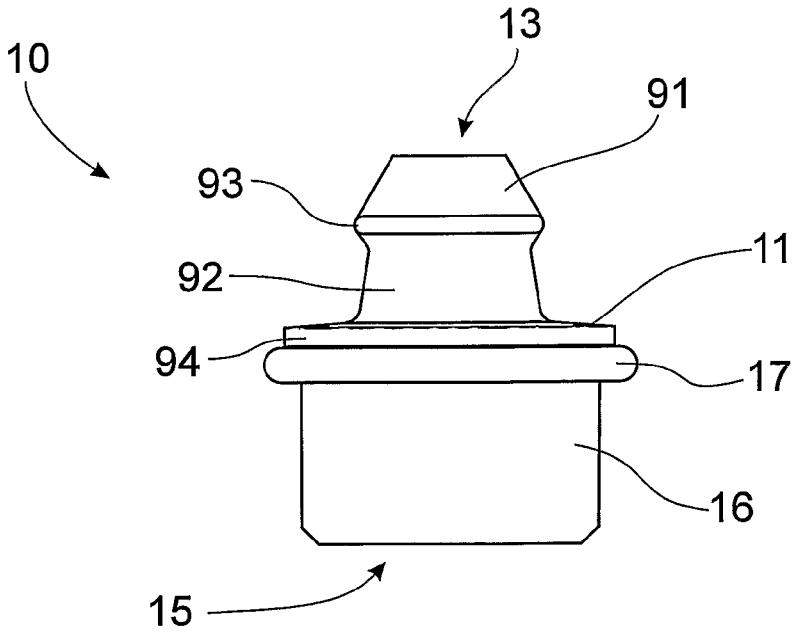
FIG. 14 is a side view of the securing device of FIG. 9, before a thread is cut into the stub of the securing device.

FIG. 14 shows an embodiment of the securing device 10 in which a thread has not been pre-cut into the stub 16. It will be appreciated that a thread can be pre-cut into the stub 16 for screwing the securing device 10 into a frame or an adaptor for the frame. Leaving the stub 16 without a thread facilitates a broader range of possible fixing options.

The above description of various embodiments of the present invention is provided for purposes of description to one of ordinary skill in the related art. It is not intended to be exhaustive or to limit the invention to a single disclosed embodiment. As mentioned above, numerous alternatives and variations to the present invention will be apparent to those skilled in the art of the above teaching. Accordingly, while some alternative embodiments have been discussed specifically, other embodiments will be apparent or relatively easily developed by those of ordinary skill in the art. Accordingly, this invention is intended to embrace all alternatives, modifications and variations of the present invention that have been discussed herein, and other embodiments that fall within the spirit and scope of the above described invention.

The invention claimed is:

1. A securing device for holding a screening panel to a support frame of a vibrating screen assembly comprising:

a body;

a securing means at an upper part of the body comprising a first shape corresponding with a complementary securing cavity on the screening panel;

a hole formed in the upper part of the body adjacent the securing means comprising a second shape corresponding with a pin of the screening panel; and a stub at a lower part of the body comprising a third shape corresponding with a corresponding socket in the support frame; and wherein the securing means comprises a tapered neck and an enlarged head at the narrower end of the neck.

2. The securing device of claim 1 further comprising a flange intermediate the upper end of the body and the lower end of the body.

3. The securing device of claim 2 including a securing ridge on the flange.

4. The securing device of claim 2 wherein the flange is suitably shaped at an outer perimeter to be engaged for tightening.

5. The securing device of claim 4 wherein the flange is shaped for engagement by a tool.

6. The securing device of claim 1 wherein the securing means comprises a ridge.

7. The securing device of claim 1 further comprising a circumferential ridge at a junction of the tapered neck and the enlarged head.

8. The securing device of claim 1 wherein the securing means comprises a recess.

9. The securing device of claim 1 wherein the securing means has a donut profile.

10. The securing device of claim 1 wherein the upper part of the body comprises a neck.

11. The securing device of claim 10 further comprising a flange intermediate the upper end of the body and the lower end of the body and a collar at a junction of the neck and the flange.

12. The securing device of claim 1 wherein the hole extends through the body from the upper part to the lower part.

13. The securing device of claim 1 wherein the stub is formed as a blank in which a thread is cut by the action of screwing the securing device into the socket in the frame.

14. The securing device of claim 1 wherein the stub is threaded.

15. The securing device of claim 1 wherein the stub is tapered.

16. A system, for holding a screening panel to a support frame of a vibrating screen assembly, comprising:

a screening panel comprising a securing cavity and a pin;

a support frame comprising a socket; and a securing device comprising:

a body;

a securing means at an upper part of the body and shaped to mate with the securing cavity on the screening panel;

a hole formed in the upper part of the body adjacent the securing means, and comprising a shape corresponding with the pin of the screening panel; and a stub at a lower part of the body and shaped to mate with the socket in the support frame; and wherein the securing means comprises a tapered neck and an enlarged head at the narrower end of the neck.

* * * * *